US006832933B2

(12) United States Patent
Bu et al.

(10) Patent No.: US 6,832,933 B2
(45) Date of Patent: Dec. 21, 2004

(54) CARD EDGE CONNECTOR WITH A CONDUCTIVE WIRE INTERCONNECTING POWER TERMINALS OF THE CONNECTOR

(75) Inventors: Sue-Wu Bu, Kunshan (CN); De-Xi Chen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 94 days.

(21) Appl. No.: 10/294,282

(22) Filed: Nov. 13, 2002

(65) Prior Publication Data

US 2003/0203679 A1 Oct. 30, 2003

(30) Foreign Application Priority Data

Apr. 30, 2002 (TW) ..... 91205991 U

(51) Int. Cl.[7] ..... H01R 24/00; H01R 25/00; H01R 27/02; H01R 31/00; H01R 33/90

(52) U.S. Cl. ..... 439/637; 439/638

(58) Field of Search ..... 439/637, 638, 439/108, 682, 189

(56) References Cited

U.S. PATENT DOCUMENTS

| | | | | |
|---|---|---|---|---|
| 5,007,888 A | | 4/1991 | Goutiere | |
| 5,112,239 A | | 5/1992 | Yagi et al. | |
| 5,263,870 A | | 11/1993 | Billman et al. | |
| 5,411,408 A | | 5/1995 | DiViesti et al. | |
| 6,102,744 A | | 8/2000 | Korsunsky et al. | |
| 6,254,435 B1 | * | 7/2001 | Cheong et al. | 439/637 |
| 6,425,770 B1 | * | 7/2002 | Lostoski et al. | 439/76.1 |
| 6,558,173 B1 | * | 5/2003 | Choy | 439/108 |
| 6,558,200 B1 | * | 5/2003 | Choy | 439/637 |

OTHER PUBLICATIONS

U.S. patent application Ser. No. 10/043,538, Edmond.
U.S. patent application Ser. No. 10/041,868, Edmond.
Page 22 of "Connector Specifier" published in Jan. 2001 by PennWell Corp.

* cited by examiner

*Primary Examiner*—Chandrika Prasad
(74) *Attorney, Agent, or Firm*—Wei Te Chung

(57) ABSTRACT

A card edge connector (1) comprises an elongated dielectric housing (10) having a card-receiving face (11), a plurality of terminals, a plurality of board locks (15), and at least one conductive wire (30). An elongated central slot (12) is defined in the card-receiving face generally along a longitudinal axis of the housing for receiving a card edge therein. The terminals comprise a plurality of signal terminals (40) and power terminals (20). The signal and power terminals are received in the housing in a predetermined pattern for electrically connecting with contact pads on the card edge. The at least one wire is received in the housing and interconnects the power terminals. The at least one wire contacts the board locks which are to be connected with power circuitry of the printed circuit board, whereby power of the printed circuit board can be transmitted to the power terminals through the board locks and the wire.

15 Claims, 11 Drawing Sheets

1

CARD EDGE CONNECTOR WITH A CONDUCTIVE WIRE INTERCONNECTING POWER TERMINALS OF THE CONNECTOR

BACKGROUND OF THE INVENTION

1. Field of the Invention

The present invention generally relates to a card edge connector, and particularly to a card edge connector having a conductive wire for electrically interconnecting power terminals thereof with a printed circuit board.

2. Description of Related Art

An electrical connector, which establishes electrical connection between a daughter card and a mother board, is commonly called a "card edge" connector. The card edge connector includes an elongated housing defining a central slot therein for receiving the daughter card. Conventional card edge connectors are disclosed in U.S. Pat. Nos. 5,263,870, 5,411,408 and 6,102,744, and page 22 of "Connector Specifier" published in January 2001 by PennWell Corp. U.S. Pat. No. 5,411,408 discloses a card edge connector having terminals with spring contact portions for engaging a card edge. U.S. Pat. No. 6,102,744 provides an electrical connector with improved contacts for preventing stubbing of the contacts upon card insertion. The contacts of the connectors mentioned above are amounted on a mother board for transmitting signals and power. A complicated circuitry are needed to be arranged on the mother board for electrically connecting tails of the contacts. Such an arrangement takes up too much space of the mother board and thus little space is left for other uses. Such an arrangement also increases the cost of the mother board. U.S. Pat. No. 5,263,870 discloses a card edge connector which includes a dielectric housing defining a central slot therein, a ground plane received in the housing having a plurality of leads for connection with circuits on a mother board, and a plurality of signal terminals and ground terminals mounted to the mother board. The ground terminals contact the ground plate for establishing a grounding path with the mother board. However, the mother board still needs a complicated circuitry for connecting power terminals of the connector.

Hence, an improved card edge connector is desired to simplify the design and manufacture of the mother board.

SUMMARY OF THE INVENTION

Accordingly, an object of the present invention is to provide a card edge connector having an integral wire for electrically interconnecting power terminals thereof, whereby a circuitry of a printed circuit board for supplying power to the card edge connector can be simplified.

A card edge connector mounted on a printed circuit board in accordance with the present invention comprises an elongated dielectric housing having a card-receiving face, a plurality of terminals, a plurality of board locks, and at least one wire. An elongated central slot is defined in the card-receiving face generally along a longitudinal axis of the housing for receiving a card edge therein. The terminals comprise a plurality of signal terminals and power terminals. The signal and power terminals are received in the housing in a selected sequence for electrically connecting with contact pads on the card edge. The at least one wire is received in the housing and interconnects the power terminals. The at least one wire contacts the board locks which are connected with traces on the printed circuit board, thereby connecting the power terminals with the traces on the printed circuit board.

Other objects, advantages and novel features of the invention will become more apparent from the following detailed description when taken in conjunction with the accompanying drawings.

DETAILED DESCRIPTION OF THE INVENTION

Figure 1:
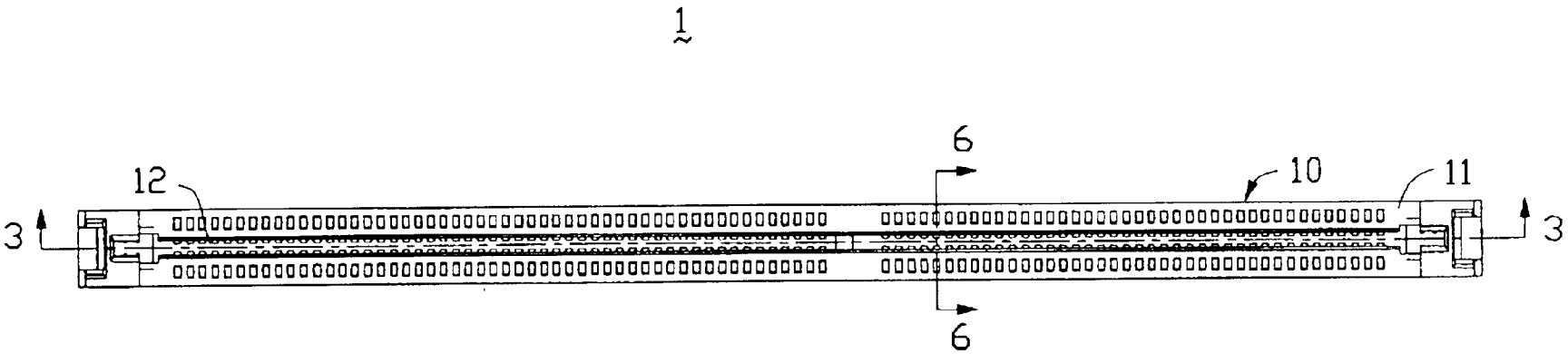
FIG. 1 is a top plan view of a card edge connector in accordance with a first embodiment of the present invention.

Referring to FIGS. 1 to 6, a card edge connector 1 in accordance with a first embodiment of the present invention comprises an elongated dielectric housing 10, a central slot 12 defined in a card-receiving face 11 of the housing 10 for receiving an edge of a card having contact pads adjacent the edge thereof (not shown) a pair of conductive wires 30, and a plurality of terminals comprising a plurality of signal terminals 40 and a plurality of power terminals 20. The signal terminals 40 and the power terminals 20 are received in the housing 10 in a predetermined pattern for electrically connecting corresponding contact pads of the card received in the central slot 12 of the housing 10. A wire-receiving slot 13 is defined in a lower terminating face 14 of the dielectric housing 10 along a longitudinal axis of the housing 10. A plurality of board locks 15 is disposed on a middle portion and opposite ends of the housing 10 for fixing the card edge connector 1 onto a printed circuit board (not shown).

The power terminals 20 comprise outer power terminals (referring to FIG. 4) and inner power terminals (referring to FIG. 5) which have substantially the same configuration except for soldering portions 23 thereof. Each power terminal 20 comprises a spring contact portion 21 for engaging a respective contact pad on the card, a retention portion 22 secured in the housing 10, a soldering portion 23 for solder connection to the printed circuit board, and a conductive portion 24 extending sidewards from a bottom of the retention portion 22. The soldering portion 23 of the outer power terminal 20 (FIG. 4) is located at a lower part of a left side of the outer power terminal 20 while the soldering portion 23 of the inner power terminal 20 (FIG. 5) extends downwardly from a bottom of the conductive portion 24 which is located generally at a right side of the inner power terminal 20. A contact point 241 is formed at a free end of the conductive portion 24 for connecting with a corresponding wire 30 (referring to FIG. 6). The signal terminals 40 are generally known in the art and thus will not be described in detail here.

Figure 2:
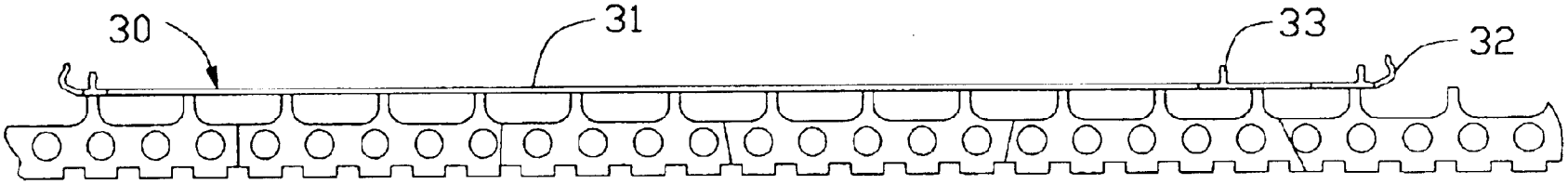
FIG. 2 is a front elevational view of a wire strip on which a conductive wire for the card edge connector of FIG. 1 is formed.
Figure 3:
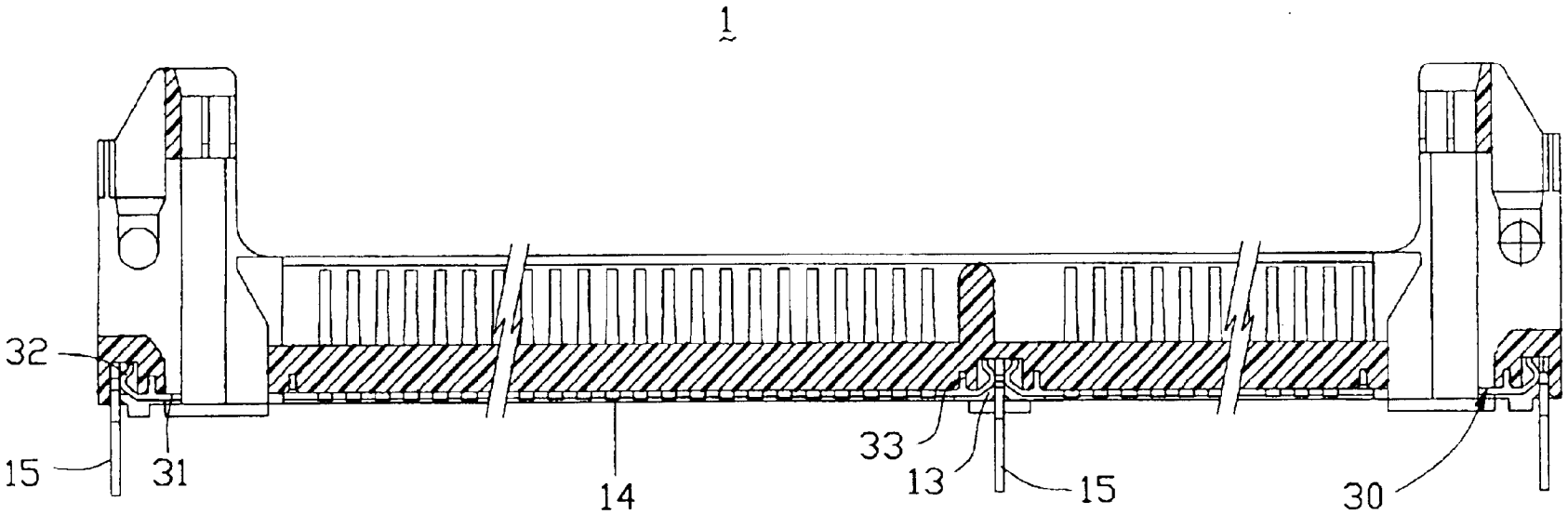
FIG. 3 is a cross-sectional view of the card edge connector taken along line 3—3 of FIG. 1.
Figure 4:
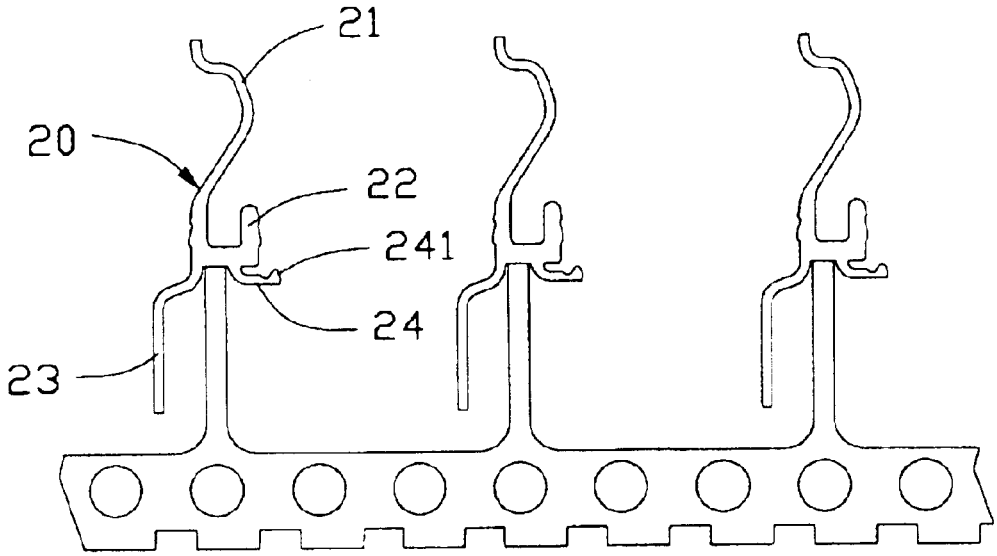
FIG. 4 is a front elevational view of a power terminal strip having a plurality of outer power terminals for the card edge connector of FIG. 1.
Figure 5:
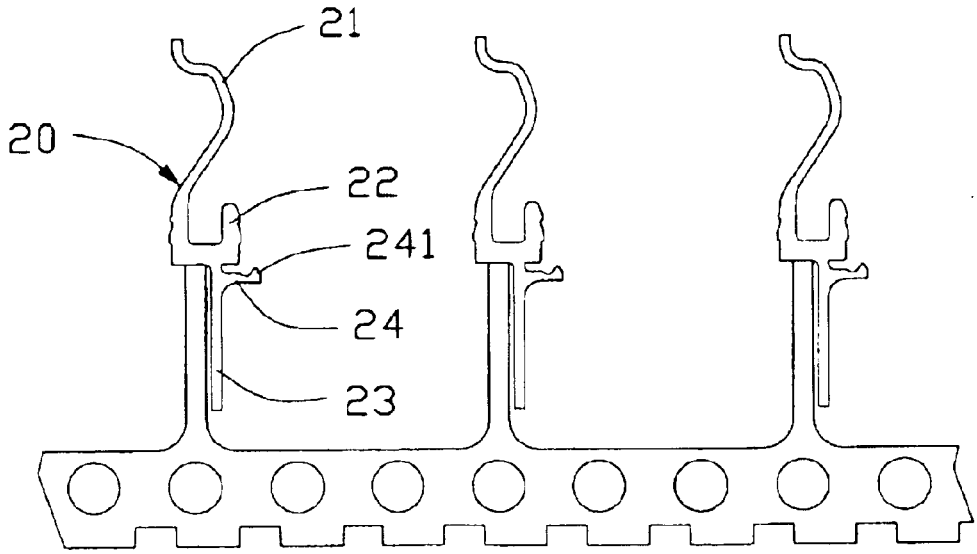
FIG. 5 is a front elevational view of a power terminal strip having a plurality of inner power terminals for the card edge connector of FIG. 1.

Referring to FIGS. 2 and 3, each wire 30 comprises an elongated portion 31, a pair of curved contacting portions 32 formed at respective opposite ends of the elongated portion 31, and a plurality of retention beams 33 extending upwardly from the elongated portion 31.

Figure 6:
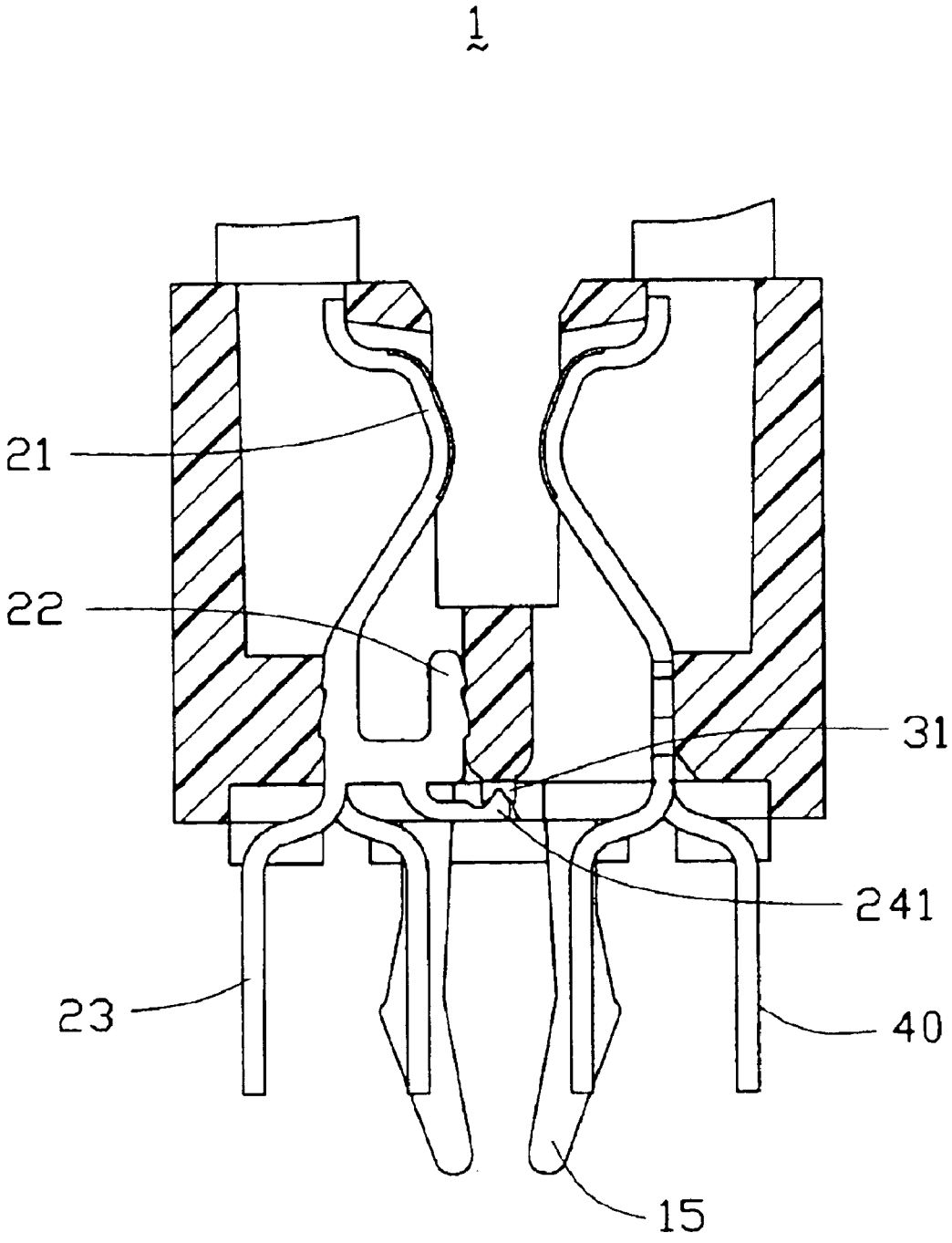
FIG. 6 is a cross-sectional view of the card edge connector taken along line 6—6 of FIG. 1.

Referring to FIGS. 3 and 6, in assembly, the pair of wires 30 is inserted into the wire-receiving slot 13 of the housing 10. The retention beams 33 engage with the housing 10 for retaining the wires 30 in the housing 10. The curved contacting portions 32 received in the middle of the housing 10 contact the board lock 15 disposed on the middle of the housing 10. The curved contacting portions 32 received in the opposite ends of the housing 10 respectively contact the board locks 15 at opposite ends of the housing 10. Therefore, the wires 30 electrically contact the board locks 15. In the present invention, the board lock 15 electrically connect with power circuitry of the printed circuit board when the board locks 15 are soldered to the printed circuit board (not shown) on which the connector 1 is mounted. The signal terminals 40 and the power terminals 20 are then inserted into the housing 10. The contact point 241 of the conductive portion 24 of each power terminal 20 contacts the bottom of the elongated portion 31 of a corresponding wire 30. Furthermore, as described above, the wires 30 electrically contact the board locks 15 and the power terminals 20 together. Therefore, the printed circuit board only needs to have the power circuitry thereof for supplying power to the connector 1 connecting with the board locks 15, rather than all of the solder portions 23 of the power terminals 20. The power of the printed circuit board can be transmitted to the power terminals 20 through the board locks 15 and the wires 30. Thus, the layout of the printed circuit board can be greatly simplified to facilitate the manufacturing and lower the cost of the printed circuit board.

FIGS. 7–12 illustrate a card edge connector 1' in accordance with a second embodiment of the present invention. Particularly referring to FIGS. 11 and 12, an elongated dielectric housing 10' defines a pair of opposite wire-receiving slots 13' in a terminating face 14' for receiving a pair of wire strips 30' therein. The longitudinal dimension of each wire-receiving slot 13' is smaller than the length of the housing 10'.

Figure 7:
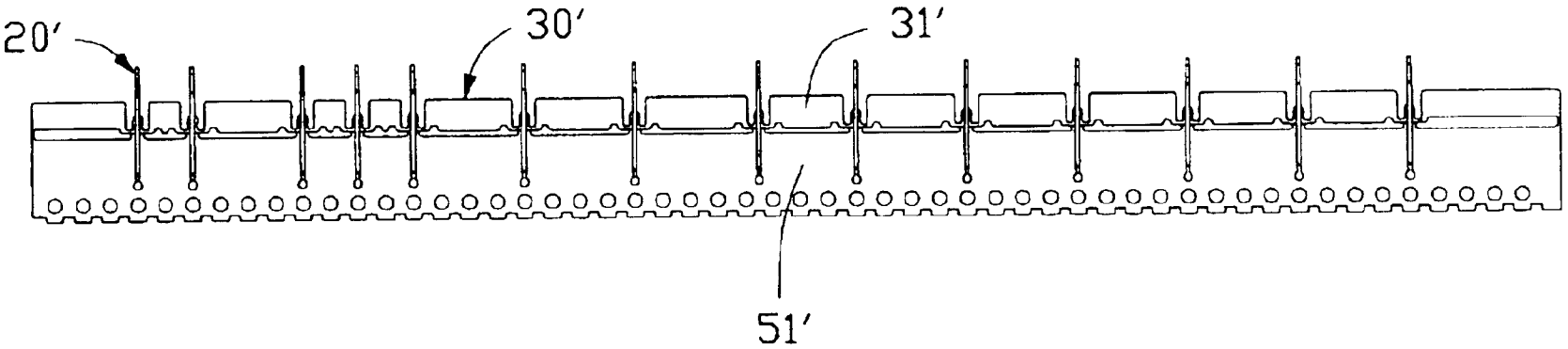
FIG. 7 is a front elevational view of a wire strip for a card edge connector in accordance with a second embodiment of the present invention.
Figure 8:
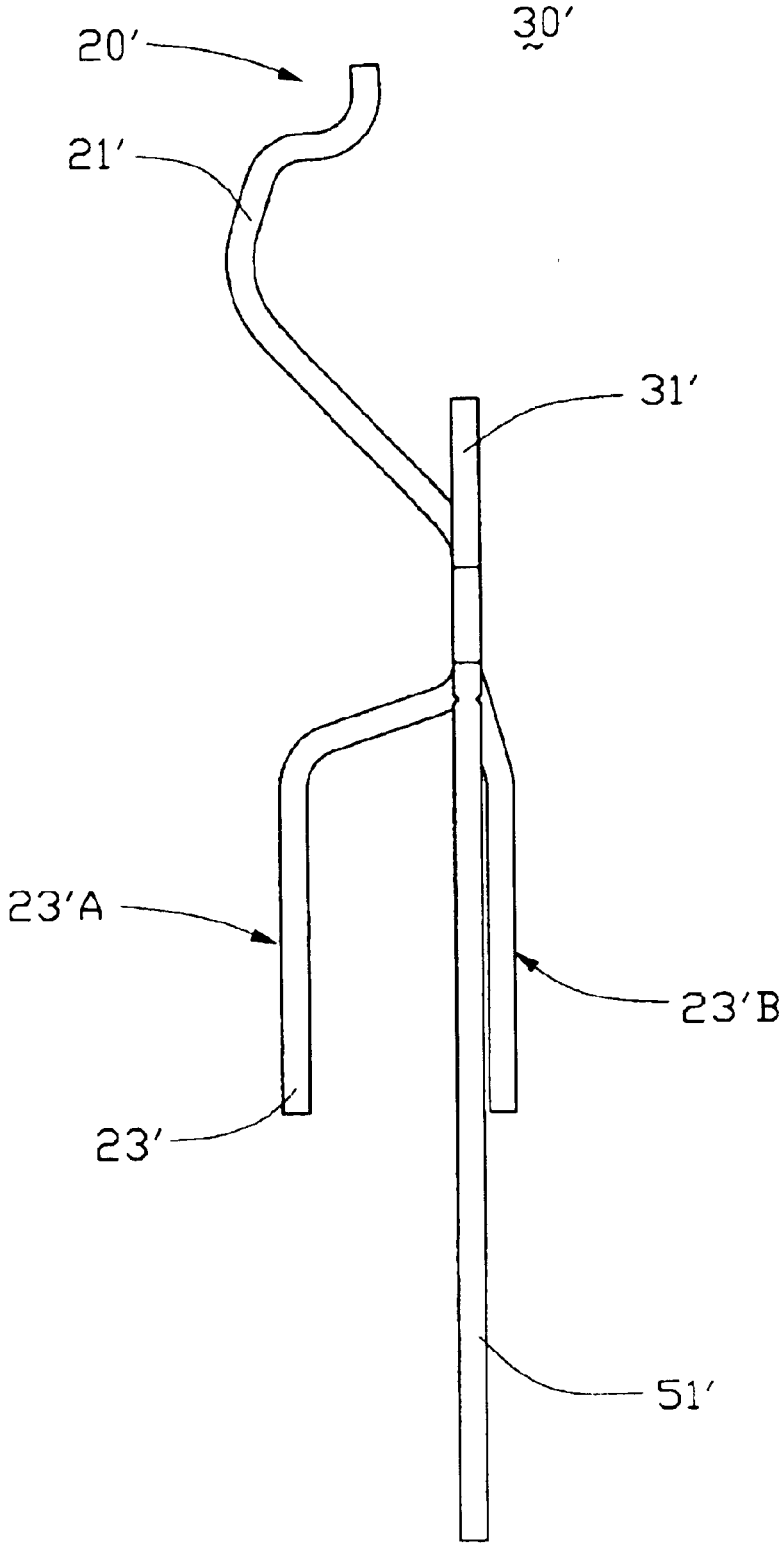
FIG. 8 is a side elevational view of the wire strip of FIG. 7.
Figure 9:
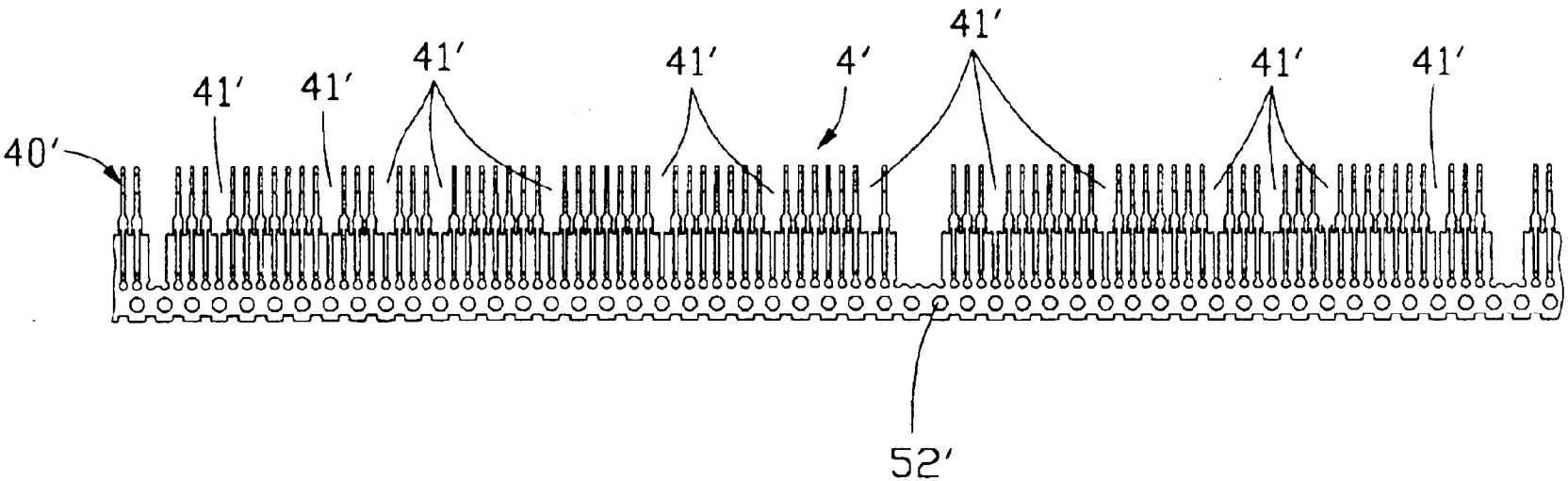
FIG. 9 is a front elevational view of a signal terminal strip having a plurality of signal terminals for the card edge connector in accordance with the second embodiment of the present invention.
Figure 10:
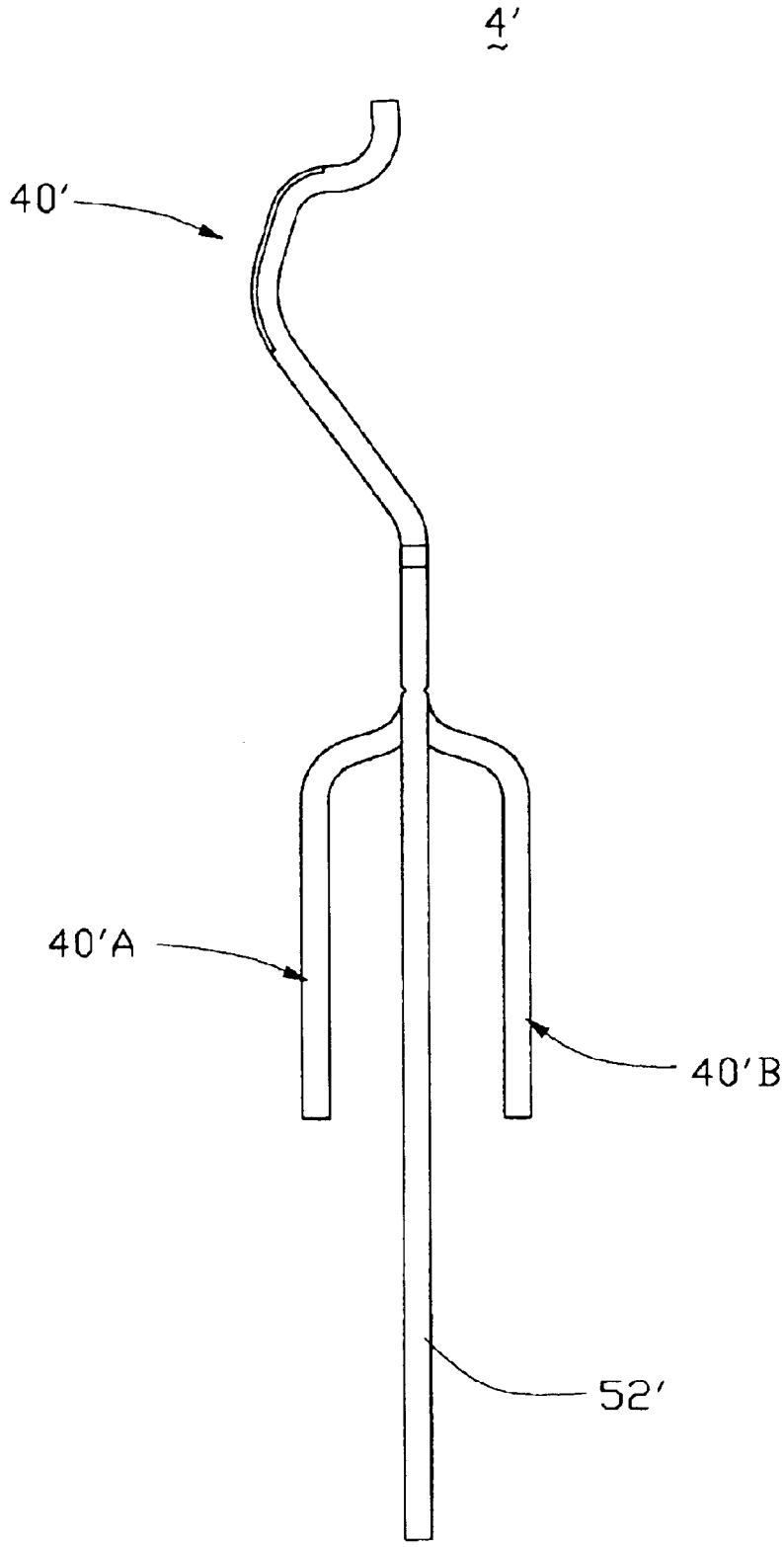
FIG. 10 is a side elevational view of the signal terminal strip of FIG. 9.
Figure 11:
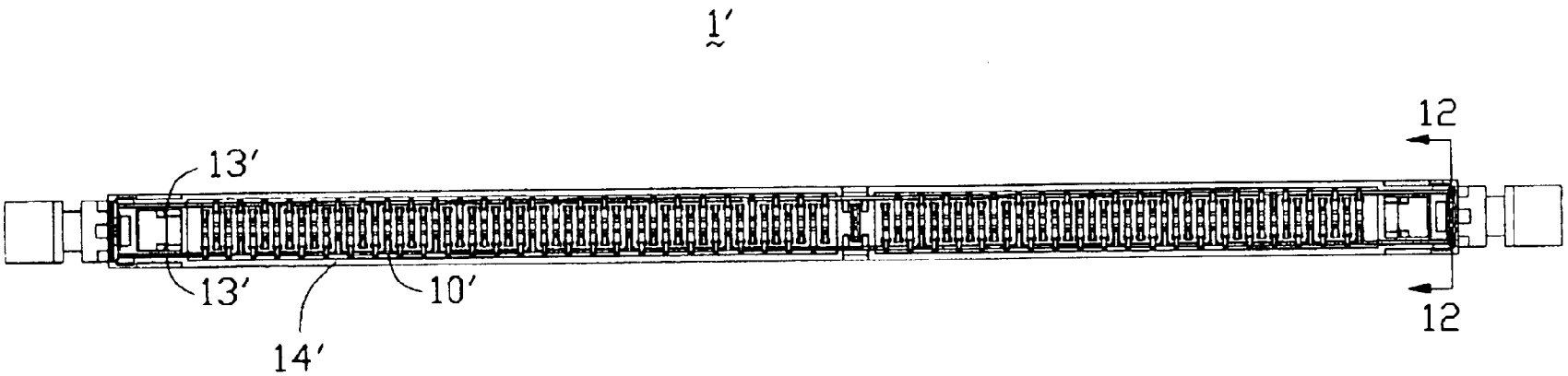
FIG. 11 is a bottom plan view of the card edge connector in accordance with the second embodiment of the present invention.

Referring to FIGS. 7 and 8, each wire strip 30' is stamped to integrally have power terminals 20' thereon and conductive sheets 31' located between every two adjacent power terminals 20' and electrically connecting therewith. Each power terminal 20' comprises a spring contact portion 21' and a soldering tail 23' for solder connection to a printed circuit board (not shown). The soldering tails 23' include inner soldering tails 23'A and outer soldering tails 23'B. The inner and outer soldering tails 23'A and 23'B are aligned in two rows and the distance between the two rows is predetermined. The distance between a wire strip carrier 51' and the outer soldering tails 23'B is smaller than the distance between the wire strip carrier 51' and the inner soldering tails 23'A. In other words, the wire strip carrier 51' is offset from a middle of the wire strip 30'. As shown in FIGS. 9 and 10, a signal terminal strip 4' includes a plurality of signal terminals 40' which are generally known in the art. The signal terminals 40' also include inner soldering tails 40'A and outer soldering tails 40'B aligned in two rows. The distance between a signal terminal strip carrier 52' and the outer soldering tail 40'B is equal to the distance between the signal terminal strip carrier 52' and the inner soldering tail 40'A. That is to say, the signal terminal strip carrier 52' is in a middle of the signal terminal strip 4'.

Figure 12:
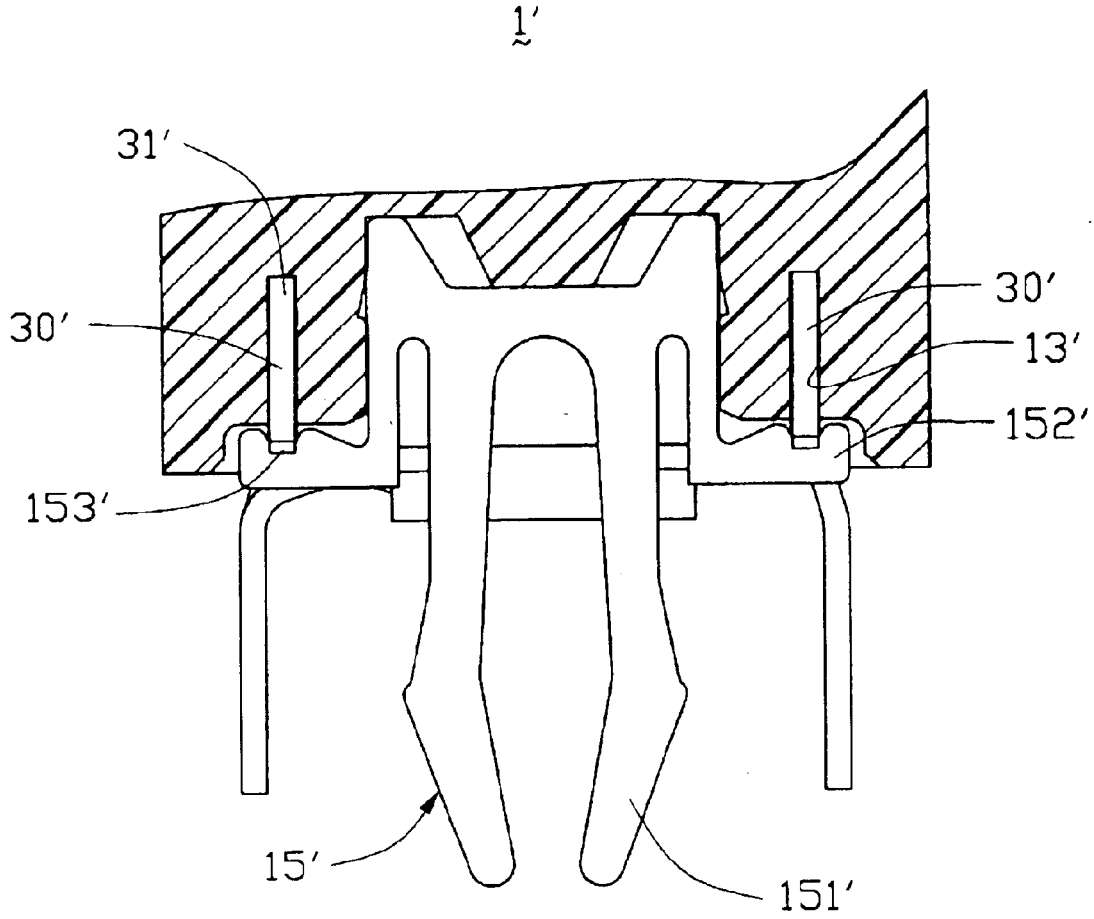
FIG. 12 is a partial, cross-sectional view of the card edge connector of FIG. 11.

Referring to FIG. 12, a plurality of board locks 15' is disposed at opposite ends of the housing 10'. Each board lock 15' comprises a pair of latches 151' and a pair of wire-receiving portions 152' extending toward opposite outer longitudinal sides of the housing 10'. Each wire-receiving portion 152' defines a recess 153' therein.

In assembly, the pair of wire strip 30' are first inserted into the two slots 13' of the dielectric housing 10'. Referring to FIG. 9, the signal terminal strip 4' has voids 41' corresponding to the positions of the power terminals 20'. Furthermore, as described above, the wire strip carrier 51' is offset from the middle of the wire strip 30' while the signal terminal strip 52' is in the middle of the terminal strip 4'. Therefore, the signal terminal strip 4' can be inserted into the slots 13' of the housing 10' later without interferencing with the wire strip 30'. The conductive sheets 31' at two ends of the wire strips 30' are respectively received in the recesses 153' of the board locks 15' and electrically connect with the board locks 15, whereby the power terminals 20' are electrically connected with the board locks 15' via the conductive sheets 31'. The printed circuit board also only needs to have the power circuitry connecting with the board locks 15'. Therefore, the layout and manufacture of the printed circuit board are simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for interconnecting a card and a printed circuit board, comprising:

a dielectric housing having a card-receiving face and a terminating face opposite to the card-receiving face, the card-receiving face defining a central slot generally along a longitudinal axis of the housing adapted for receiving an edge of the card, at least one wire-receiving slot being defined at a lower central portion of the terminating face;

a plurality of terminals comprising a plurality of signal terminals and a plurality of power terminals, the signal terminals and the power terminals being received in the housing in a predetermined pattern adapted for electrically connecting the card received in the housing; and at least one wire received in the wire-receiving slot of the dielectric housing and electrically interconnecting the power terminals, each wire comprising an elongated portion and a pair of curved contacting portions formed at respective opposite ends of the elongated portion.

2. The card edge connector as described in claim 1, wherein the at least one wire comprises a pair of wires received in the wire-receiving slot.

3. The card edge connector as described in claim 1, wherein each power terminal comprises a spring contact portion adapted for engaging a corresponding contact pad on the card, a retention portion secured in the housing, a soldering portion adapted for solder connection to the printed circuit board, and a conductive portion extending sidewards from the retention portion, the conductive portion forming a contact point at an end thereof for connecting the elongated portion of a corresponding wire.

4. The card edge connector as described in claim 1, further comprising a plurality of board locks disposed at a middle portion and opposite ends of the dielectric housing and contacting the respective curved contacting portions of the wires.

5. The card edge connector as described in claim 1, wherein the at least one wire-receiving slot of the terminating face of the dielectric housing defines a pair of opposite wire-receiving slots, and the at least one wire comprises a pair of wires received in the pair of opposite wire-receiving slots.

6. The card edge connector as described in claim 5, wherein the longitudinal dimension of each wire-receiving slot is smaller than the length of the dielectric housing.

7. The card edge connector as described in claim 1, wherein said at least one wire is engaged with but discrete from said power terminals.

8. A card edge connector for interconnecting a card and a printed circuit board, comprising:

a dielectric housing having a card-receiving face and a terminating face opposite to the card-receiving face, the card-receiving face defining a central slot generally along a longitudinal axis of the housing adapted for receiving an edge of the card, the terminating face defining at least one wire-receiving slot at a central portion thereof generally along the longitudinal axis of the housing;

a plurality of terminals comprising a plurality of signal terminals and a plurality of power terminals, the signal terminals and the power terminals being received in the housing in a predetermined pattern adapted for electrically connecting the card received in the housing;

at least one wire received in the at least one wire-receiving slot of the housing and electrically interconnecting the power terminals; and a plurality of board locks in the housing adapted for being connected with power circuitry on the printed circuit board and contacting the at least one wire; wherein said power terminals are located by two sides of the central slot, said power contacts include respectively contact points extending toward and engaging with said conductive wire for electrical connection therebetween, and thus said at least one conductive wire is shared by the power contacts located by two sides of the central slot.

9. The card edge connector as described in claim 8, wherein the at least one wire-receiving slot comprises a pair of opposite wire-receiving slots, and the at least one wire comprises a pair of wires received in the pair of respective wire-receiving slots.

10. The card edge connector as described in claim 8, wherein said at least one wire is engaged with but discrete from said power terminals.

11. An electrical connector comprising:

an insulative housing receiving a plurality of signal terminals, a plurality of power terminals and at least one board lock for retaining the electrical connector to a printed circuit board and for electrically connecting power circuitry of the printed circuit board; and a conductive wire electrically connecting the power terminals and the board lock together whereby power of the printed circuit board can be transmitted to the power terminals via the board lock and the conductive wire;

wherein the conductive wire forms a curved contact portion at an end thereof, the curved contact portion electrically engaging with the at least one board lock.

12. The electrical connector as described in claim 11, wherein said wire is engaged with but discrete from said power terminals.

13. The electrical connector as described in claim 11, wherein the wire has at least one retention beam engaging with the insulative housing.

14. The electrical connector as described in claim 11, wherein the insulative housing defines a central slot for receiving an edge of a daughter card to be mated with the electrical connector, and said conductive wire is located in vertical alignment with said central slot.

15. The electrical connector as described in claim 14, wherein said power terminals are located by two sides of the central slot, said power contacts including contact points extending toward and engaged with said conductive wire for electrical connection therebetween, and thus said conductive wire being shared by the power contacts located by two sides of the central slot.

* * * * *